US010299638B2

(12) United States Patent
Henson et al.

(10) Patent No.: US 10,299,638 B2
(45) Date of Patent: May 28, 2019

(54) DISPENSER

(71) Applicant: Wausau Paper Towel & Tissue, LLC, Mosinee, WI (US)

(72) Inventors: Mark Henson, Danville, KY (US); Adam T. Elliott, Lexington, KY (US)

(73) Assignee: Essity Operations Wausau LLC, Mosinee, WI (US)

( * ) Notice: Subject to any disclaimer, the term of this patent is extended or adjusted under 35 U.S.C. 154(b) by 319 days.

(21) Appl. No.: 15/397,893

(22) Filed: Jan. 4, 2017

(65) Prior Publication Data

US 2017/0188760 A1 Jul. 6, 2017

Related U.S. Application Data

(60) Provisional application No. 62/275,332, filed on Jan. 6, 2016.

(51) Int. Cl.

| | |
|---|---|
| ***A47K 10/38*** | (2006.01) |
| ***A47K 10/22*** | (2006.01) |
| ***A47K 10/36*** | (2006.01) |
| *A47K 10/32* | (2006.01) |

(52) U.S. Cl.

CPC ..... *A47K 10/38* (2013.01); *A47K 10/22* (2013.01); *A47K 10/3643* (2013.01); *A47K 10/3687* (2013.01); *A47K 10/3637* (2013.01); *A47K 2010/3253* (2013.01)

(58) Field of Classification Search

CPC .... A47K 10/38; A47K 10/22; A47K 10/3643; A47K 10/3687; A47K 10/3637; A47K 2010/3253

See application file for complete search history.

(56) References Cited

U.S. PATENT DOCUMENTS 3,007,650 A * 11/1961 Burton ..... A47K 10/3687 242/560.1
3,017,131 A * 1/1962 Wooster ..... A47K 10/36 226/129
4,010,909 A * 3/1977 Bastian ..... A47K 10/3687 226/91
4,067,509 A * 1/1978 Graham, Jr. ..... A47K 10/3687 242/560.1
4,137,805 A * 2/1979 DeLuca ..... A47K 10/3687 226/110
4,378,912 A * 4/1983 Perrin ..... A47K 10/3687 226/91
4,403,748 A * 9/1983 Cornell ..... A47K 10/3687 226/129

(Continued)

OTHER PUBLICATIONS

International Search Report and Written Opinion for Application No. PCT/US2017/012157 dated Apr. 6, 2017.

*Primary Examiner* — Michael E Gallion
(74) *Attorney, Agent, or Firm* — Merchant & Gould P.C.

(57) ABSTRACT

A rolled media dispenser is disclosed. In one example, the dispenser includes a transfer bar for automatically transferring paper from a completely depleted stub roll to a primary roll. In one example, the transfer bar includes a lift member that prevents transfer of the paper from the stub roll to the primary roll when paper in the stub roll is present and includes a cam lift member that prevents the transfer of paper from the stub roll to the primary roll as long as paper from the stub roll is present beneath the cam lift member.

17 Claims, 20 Drawing Sheets

(56) References Cited

U.S. PATENT DOCUMENTS 4,487,375 A * 12/1984 Rasmussen ..... A47K 10/3687 226/174
4,756,485 A * 7/1988 Bastian ..... A47K 10/3687 242/560.1
4,807,824 A * 2/1989 Gains ..... A47K 10/3687 242/560.1
5,302,167 A * 4/1994 Kley ..... B31F 1/07 226/91
5,400,982 A * 3/1995 Collins ..... A47K 10/3687 242/560
5,924,617 A 7/1999 LaCount et al.
6,152,397 A * 11/2000 Purcell ..... A47K 10/3687 242/560.1
6,314,850 B1 11/2001 Morand
6,354,533 B1 * 3/2002 Jespersen ..... A47K 10/36 242/560.1
6,446,901 B1 9/2002 Haen et al.
6,460,798 B1 * 10/2002 Haen ..... A47K 10/3687 242/560
6,553,879 B2 4/2003 Morand
6,736,348 B1 * 5/2004 Formon ..... A47K 10/3687 242/559.4
6,826,985 B2 * 12/2004 Broehl ..... B65H 35/08 225/1
6,892,620 B2 * 5/2005 Kapiloff ..... A47K 10/36 225/14
7,040,566 B1 * 5/2006 Rodrian ..... A47K 10/36 242/563
7,357,348 B2 4/2008 Kananen
7,500,420 B2 3/2009 Cvjetkovic et al.
7,765,908 B1 8/2010 Hearn
7,841,556 B2 * 11/2010 Elliott ..... A47K 10/3687 242/564.2
7,984,872 B2 7/2011 Kuehneman et al.
7,987,756 B2 8/2011 Lewis et al.
8,082,827 B2 * 12/2011 Friesen ..... B26D 1/42 83/337
8,146,471 B2 4/2012 Hansen et al.
8,220,684 B1 7/2012 Keily et al.
8,424,431 B1 * 4/2013 Jackman ..... B26D 1/345 83/343
8,468,920 B2 6/2013 Hagleitner
8,578,826 B2 11/2013 Hansen et al.
8,733,218 B2 5/2014 Hansen et al.
8,763,946 B1 7/2014 Keily
8,763,947 B2 7/2014 Keily et al.
9,027,871 B2 5/2015 Kuehneman et al.
9,211,042 B2 * 12/2015 Rozek ..... B65H 16/005
9,241,601 B2 1/2016 Case et al.
9,326,648 B2 5/2016 Trampolski
10,105,020 B2 * 10/2018 Carper ..... A47K 10/3656
10,159,389 B2 * 12/2018 Goeking ..... A47K 10/36
2010/0286817 A1 * 11/2010 Goeking ..... A47K 10/26 700/231
2010/0286818 A1 * 11/2010 Goeking ..... A47K 10/26 700/232
2011/0233254 A1 9/2011 Lundqvist et al.
2012/0167739 A1 * 7/2012 Lewis ..... B26D 5/00 83/663
2012/0255413 A1 * 10/2012 Osborne, Jr. ..... A47K 10/3687 83/436.5
2013/0161346 A1 * 6/2013 Wolme ..... A47K 10/38 221/26
2014/0367507 A1 * 12/2014 Trampolski ..... A47K 10/3687 242/560.1
2015/0083846 A1 3/2015 Budz et al.
2015/0150422 A1 6/2015 Ochoa, Sr. et al.
2015/0305578 A1 10/2015 Keily et al.
2016/0060064 A1 3/2016 Rozek et al.
2016/0157682 A1 6/2016 Keily et al.
2016/0242603 A1 8/2016 Cvjetkovic

* cited by examiner

DISPENSER

CROSS-REFERENCE TO RELATED APPLICATIONS

The present application claims priority from U.S. Provisional Patent Application No. 62/275,332, filed Jan. 6, 2016, the disclosure of which is hereby incorporated by reference in its entirety.

BACKGROUND

Dispensers for dispensing media are known. One type of dispenser is a mechanical dispenser which retains one or more rolls of paper towels within a housing, and dispenses individual sheets cut from the roll when a user pulls on the sheet. In some dispensers of this type, the primary or main roll of media can be transferred to a different location within the dispenser when sufficiently depleted to allow for the installation of a new primary roll. Once this transfer occurs, the dispenser will continue to dispense from the same roll, referred to as a stub roll, until it is depleted at which point the dispenser will begin dispensing sheets from the full primary roll. A transfer mechanism is provided in some dispensers of this type to facilitate the switch from dispensing paper from the stub roll to the primary roll. Some shortcomings of existing transfer mechanisms is that the transfer will occur before the stub roll is completely depleted which results in waste since the paper is then never dispensed. The operation of transferring a partially depleted primary roll into the stub roll location can also be cumbersome in some times of dispensers of this type.

SUMMARY

In general terms, this disclosure is directed to a dual roll paper towel dispenser, a method of dispensing towel from a dual roll paper towel dispenser, and a method of servicing a dual roll paper towel dispenser. In one example, a dispenser is disclosed which has a housing defining an interior cavity within which a primary roll support arrangement for holding a primary paper roll and a stub roll support arrangement for holding a depleted primary paper roll, known as a stub roll, are positioned. The housing has an outlet opening for dispensing paper from either of the primary or stub rolls. The dispenser also includes a pinch roller, a drum roller, and transfer mechanism pivotally mounted within the housing interior cavity. The transfer mechanism can have a pivot axis, a pinch finger member extending in a second direction from the pivot axis and a lift member extending in a first direction from the pivot axis. The lift member is for holding the pinch member away from the pinch and drum rollers as long as paper in the stub roll exists. The cam lift member is located between the lift member and the pinch member. The cam lift is for preventing rotation of the transfer mechanism such that the pinch member is held away from the pinch and drum rollers when paper from the stub roll exists. In one example, the pinch roller, drum roller, stub roll support arrangement, and transfer mechanism are components of a dispensing assembly that can be inserted into the dispenser housing.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclose herein are based.

DETAILED DESCRIPTION

Figure 1:
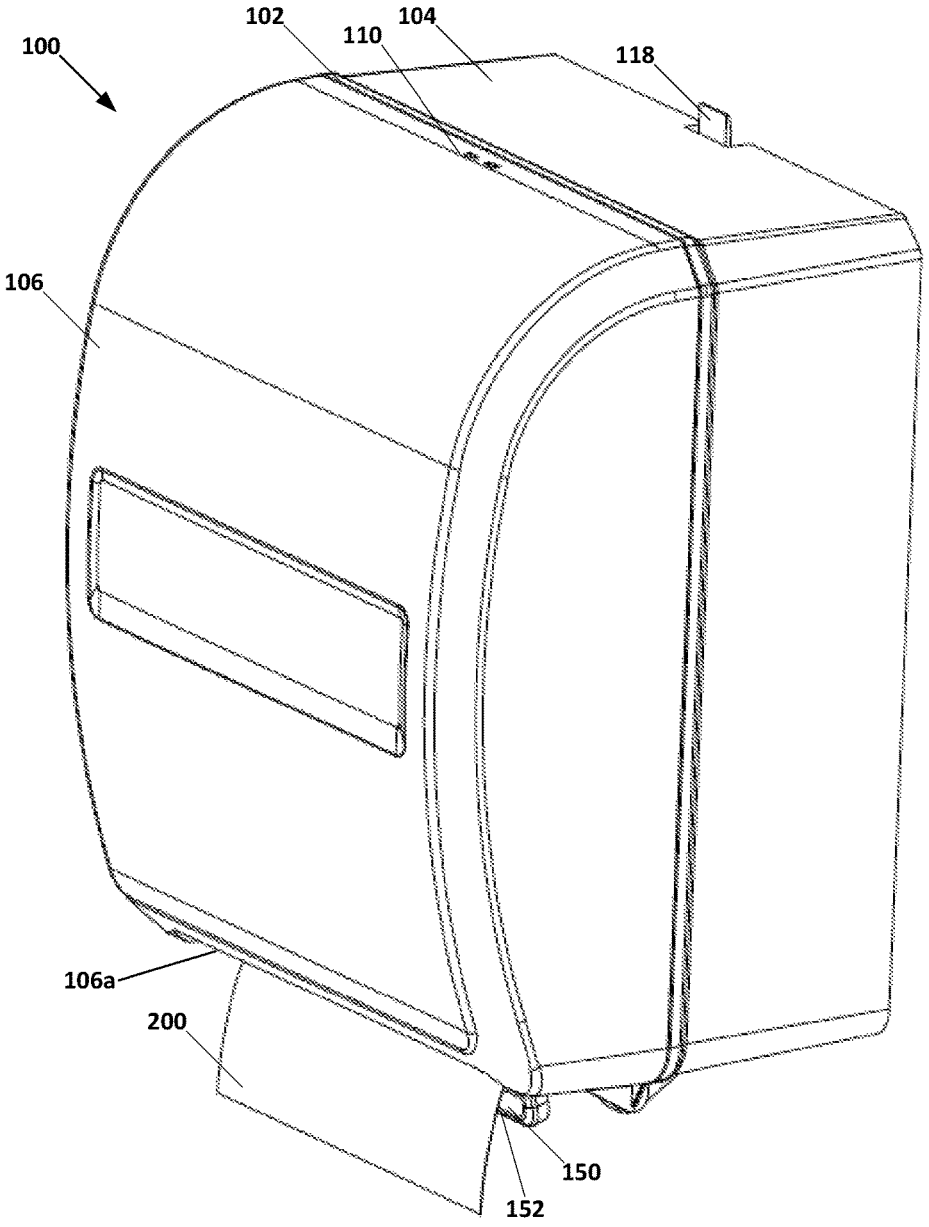
FIG. 1 is a perspective view of a dispenser having features in accordance with the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring to FIG. 1, a dispenser 100 for dispensing paper towel sheets 200 is shown. The dispenser includes a housing 102 having a housing body 104 and a cover 106 removably mountable to the housing body 104. In the example shown, the cover 106 has a discharge opening 106*a* for the dispensation of the paper towel sheets 200. Although reference to paper towel sheets is made herein, the disclosure is in no way limited to paper towels and may be utilized with any type of rolled media.

Figure 2:
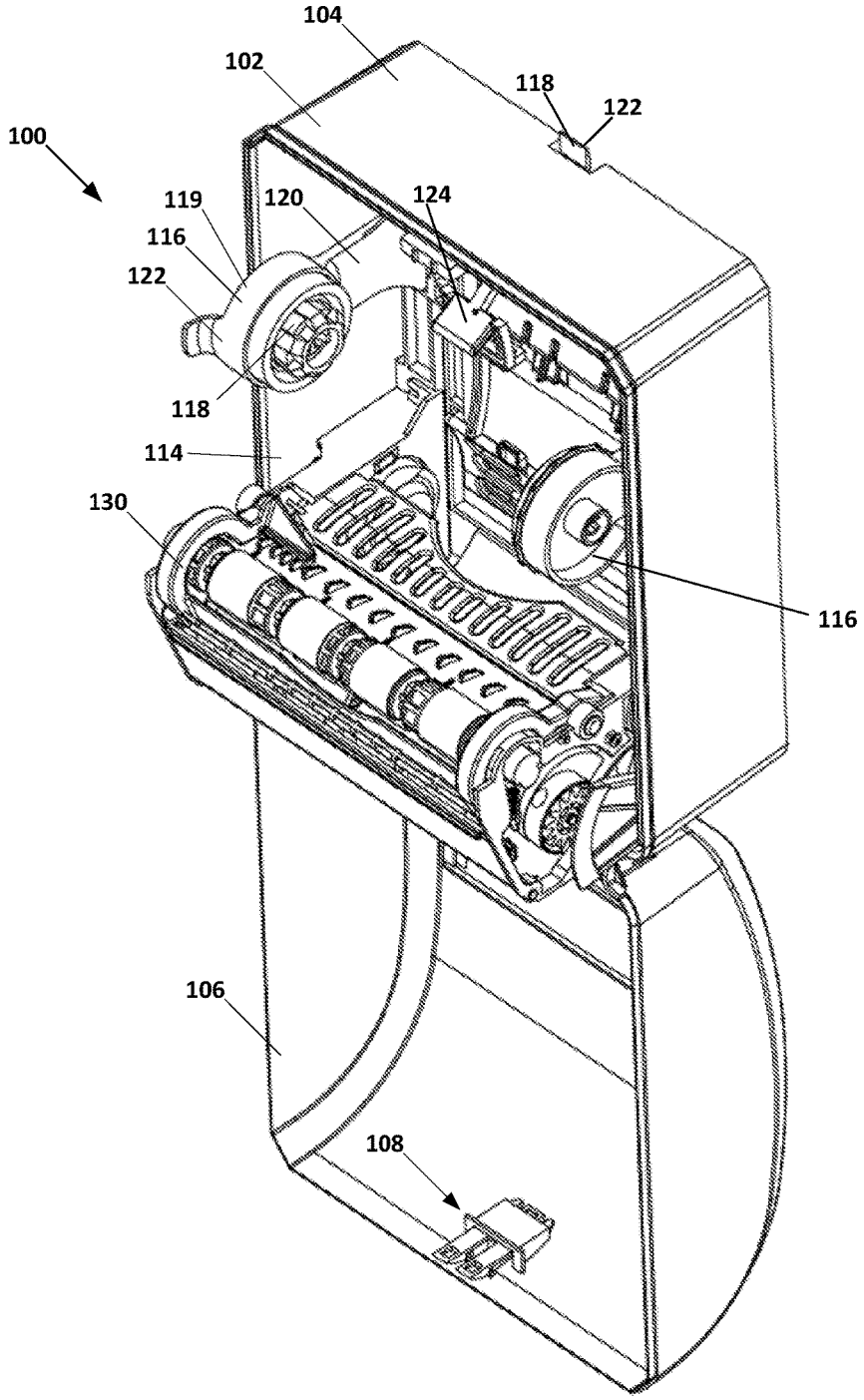
FIG. 2 is a perspective view of the dispenser shown in FIG. 1, with a cover of the dispenser in an open position with respect to a housing body of the dispenser.
Figure 3:
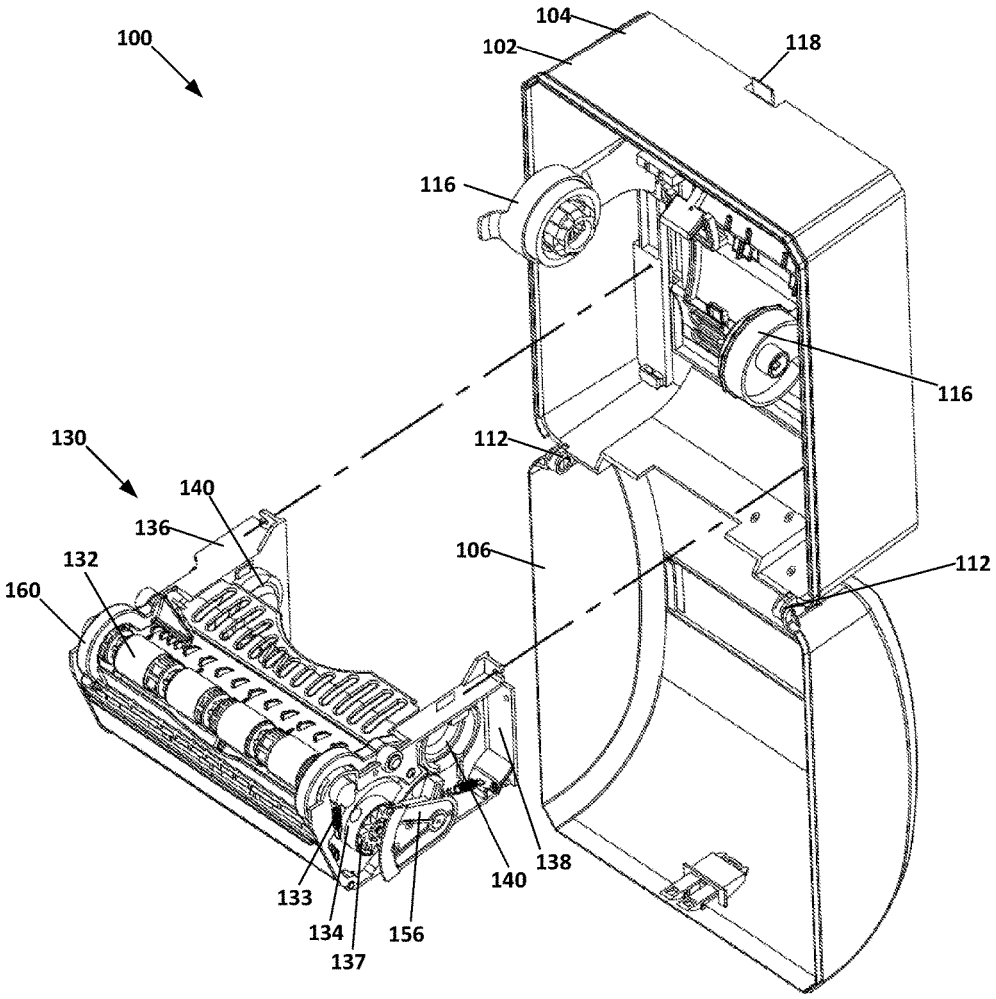
FIG. 3 is an exploded perspective view of the dispenser view of FIG. 2, with a dispensing assembly of the dispenser of FIG. 1 removed from the housing body.

Referring to FIGS. 2 and 3, it can be seen that the cover 106 is rotatable with respect from the closed position shown in FIG. 1 to an open position. The cover 106 can be retained in the closed position by a latch 108 which can be disengaged by the insertion of a key (not shown) through an opening 110 in the cover 106. The cover 106 is connected to the housing body 104 at a pair of pivot joints 112. When desired, the pivot joints 112 can be disengaged such that the cover 106 can be fully removed from the housing body 104. In an alternative arrangement, the cover 106 is removable from the housing body 104 without a pivot joint being provided. The pivot joints 112 are more easily seen at FIG. 3.

Figure 12:
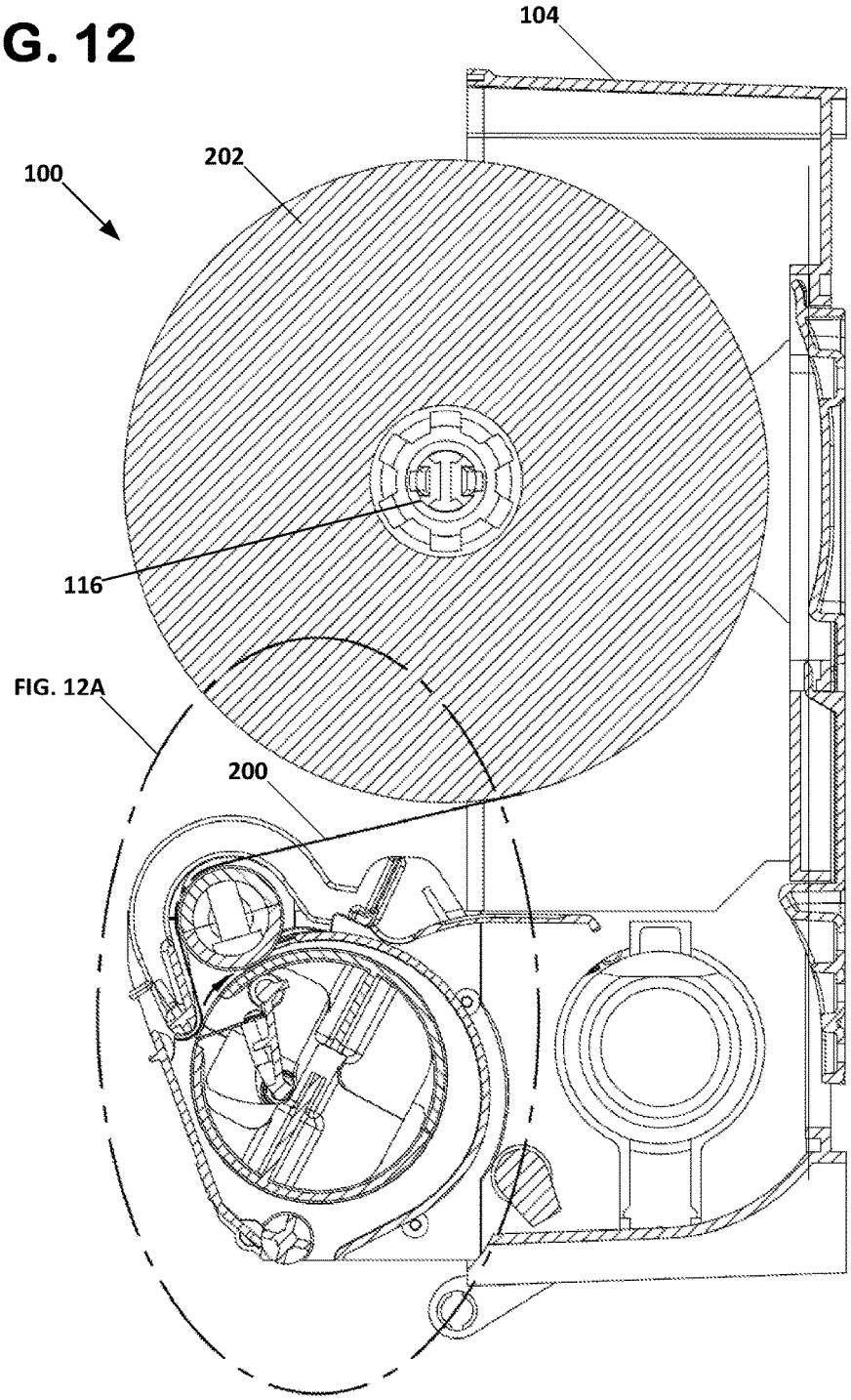
FIG. 12 is a side cross-sectional view of the dispenser shown in FIG. 1 with a primary roll installed and before the paper from the primary roll has been feed through the outlet opening of the dispenser.

Together, the cover 106 and housing body form an interior cavity 114 within which a primary roll 202 of paper can be stored (see FIG. 12). The primary roll 202 is removably supported by a primary roll support arrangement including a pair of supports 116 about which the roll 202 can rotate when dispensing sheets. Each of the supports 116 includes a hub member 118 supported by an arm 120 which is attached to the housing body 104. A tab member 122 can be used to deflect the support 116 away from the center of the dispenser to allow for a roll 202 to be inserted or removed. Once the tab member 122 is released, the hub member 118 will engage into the core of the roll 202, if a roll 202 is installed.

As most easily seen at FIG. 2, an indicator arrangement 119 can be provided within the housing body 104 to indicate when the primary roll 202 has been depleted to a certain extent. For example, a ride member 124 that follows against the outer surface of the roll 202 can cause an indicator flag 122 to be externally viewable to an operator when the outer diameter of the primary roll 202 is reduced to about three to four inches.

The dispenser 100 can also be provided with a dispensing mechanism 130 that is inserted into the interior cavity 114 of the dispenser 100, as shown at FIG. 2. As discussed in more detail below, the dispensing mechanism 130 dispenses and cuts sheets of paper from the primary roll location, dispenses and cuts sheets of paper from a stub roll location, and transfers paper from the stub roll location to the primary roll location once the stub roll paper has been completely depleted. Referring to FIG. 3, it can be seen that the dispensing mechanism 130 can be removed from the dispenser housing 102 in its entirety. The dispensing mechanism 130 can be secured to the housing 104 with fasteners, such as clips or screws.

The dispensing mechanism 130 can be provided with a pair of deflectable roll supports 140 for retaining the core of a stub roll 204. The stub roll 204 can be seen supported by the roll supports at, for example, FIG. 14. The stub roll 204 is the primary roll 202 once the primary roll 202 has been sufficiently depleted and moved to the stub roll supports 140.

Figure 4:
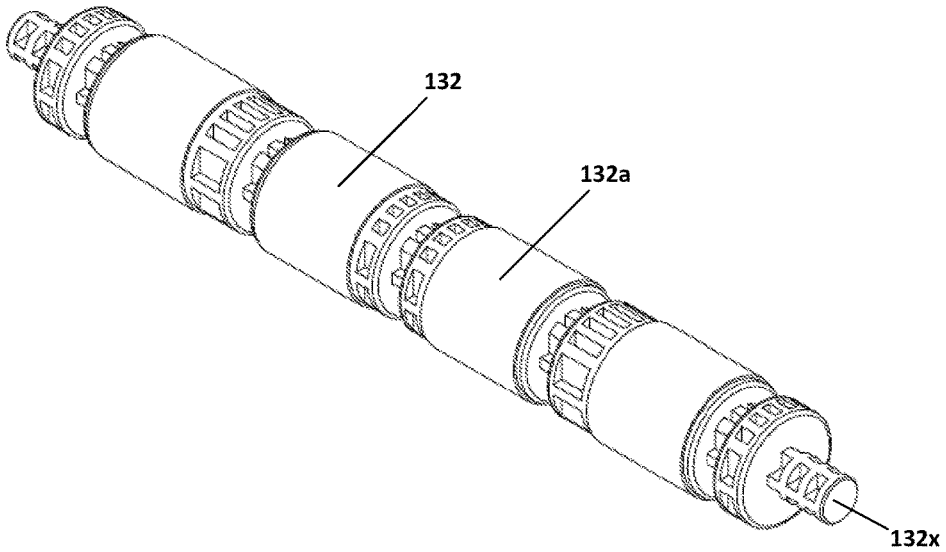
FIG. 4 is a perspective view of a pinch roller of the dispensing assembly shown in FIG. 3.
Figure 5:
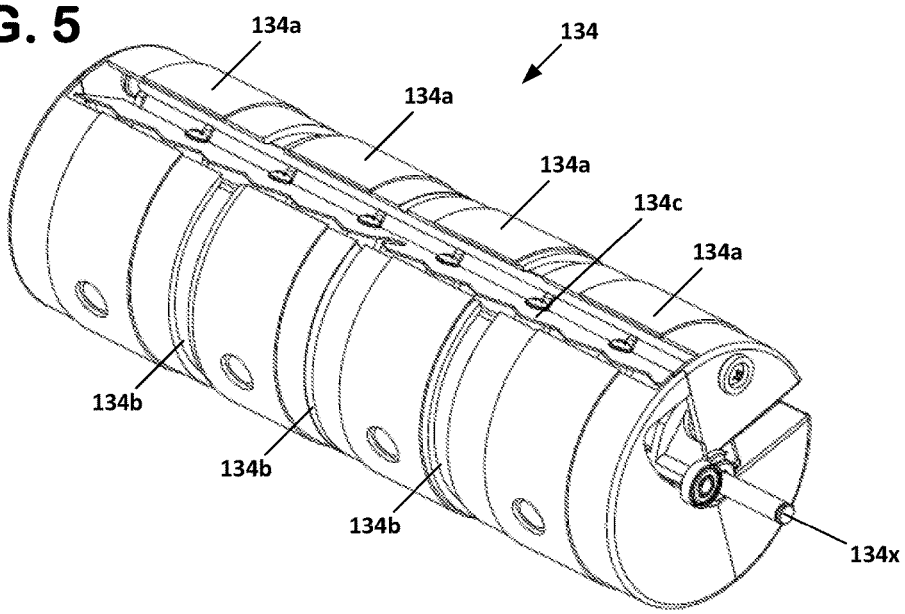
FIG. 5 is a perspective view of a drum roller of the dispensing assembly shown in FIG. 3.

The dispensing mechanism 130 can also be provided with a pinch roller 132 and a drum roller 134, respectively. The pinch and drum rollers 132, 134 are shown in isolation at FIGS. 4 and 5, respectively. Each of the pinch and drum rollers 132, 134 are rotatably disposed in the dispensing mechanism 130 and are supported by a pair of support walls 136, 138, as shown at FIG. 3. The pinch roller 132 rotates about an axis 132*x* while the drum roller 134 rotates in an opposite direction about an axis 134*x*. The drum roller 134 also includes an internal cutting blade 134*c* that extends past the friction surfaces each time the drum roller 134 completes a rotation such that a sheet from the primary roll 202 or stub roll 204 is cut.

The pinch roller 132 includes a plurality of friction surfaces 132*a* while the drum roller 134 also includes a plurality of friction surfaces 134*a*, each separated by a groove 134*b*. As paper from the roll 202 or 204 passes between the rollers 132, 134, the friction surfaces 132*a*, 134*a* frictionally engage the paper to feed it towards an outlet as the rollers 132, 134 operate in opposite directions. When no paper is present, the friction surfaces 132*a*, 134*a* engage each other such that the pinch roller 132 is rotated by the drum roller 134. In one example, the friction surfaces 132*a*, 134*a* are formed by an elastomeric component. In the example shown, the pinch roller 132 is held against the drum roller 134 by a pair of springs 133, as can be seen at FIGS. 3 and 7.

Figure 6:
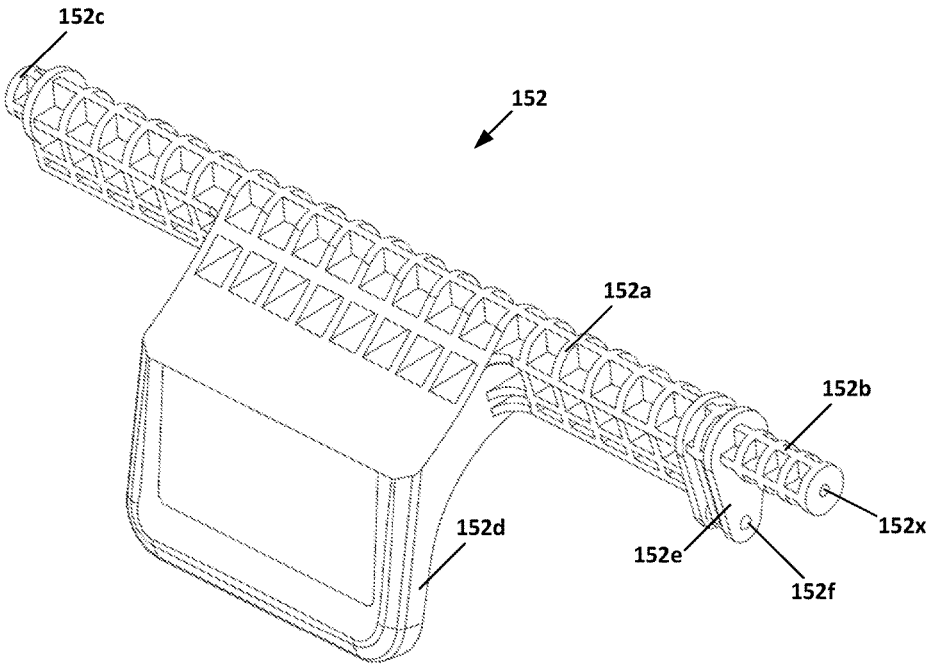
FIG. 6 is a perspective view of a push bar of the dispensing assembly shown in FIG. 3.
Figure 7:
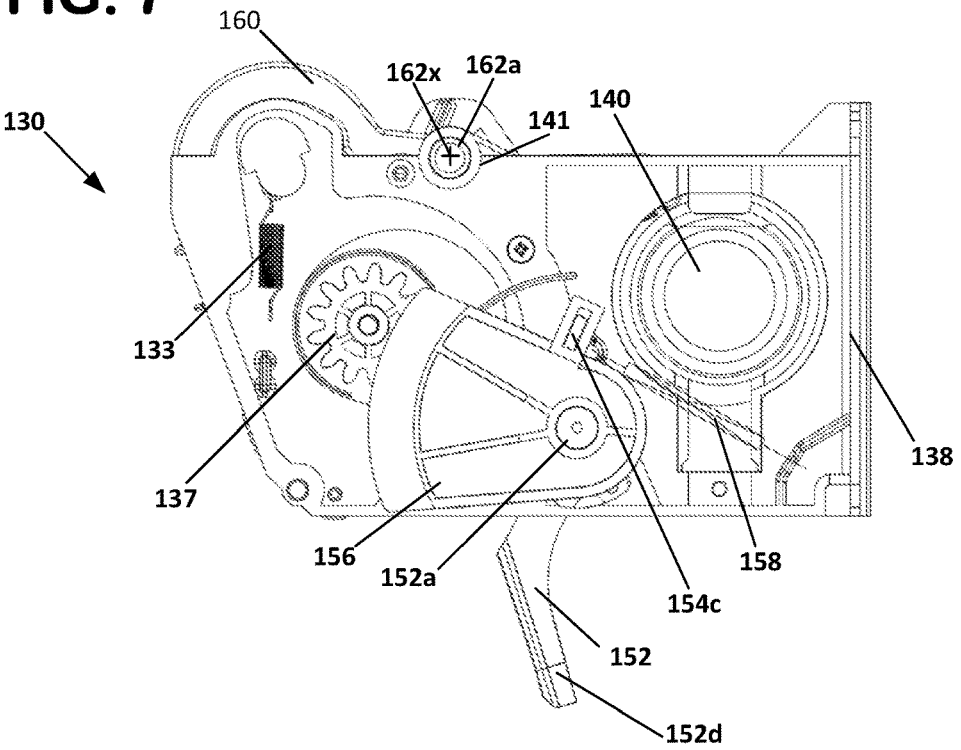
FIG. 7 is a side view of the dispensing assembly shown in FIGS. 2 and 3.
Figure 8:
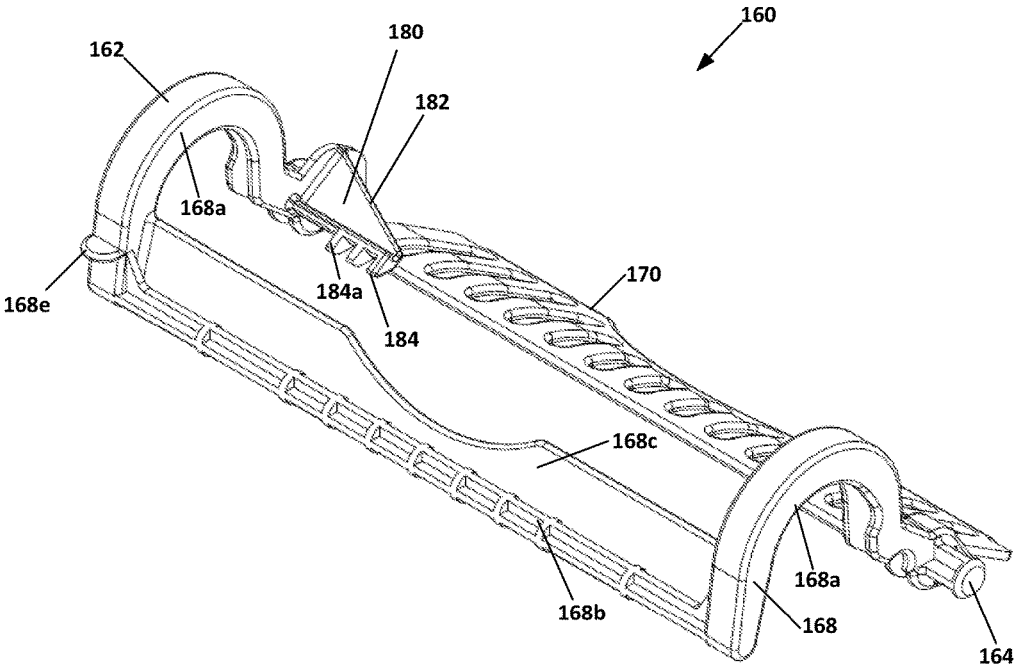
FIG. 8 is a perspective view of a transfer mechanism of the dispensing assembly shown in FIGS. 2 and 3.

The dispenser 100 is also provided with a manual advance mechanism 150 which includes a push bar 152 (FIG. 1), and in FIGS. 6-8, a torsion spring 154, and a segment gear body 156 having teeth 156*a* which engage the teeth 137*a* of a drive gear 137 on the drum roller 134. During normal operation, a user will pull a sheet 200 from the dispenser which will cause the rollers 134, 136 to rotate such that paper is advanced off of the roll 202 or 204. However, in some instances, such as when a primary roll 202 is initially loaded or when dispensing is transferred from the stub roll 204 to the primary roll 202, a sheet 200 will not advance sufficiently for a user to grab the sheet 200. In these cases, the manual advance mechanism 150 can be utilized by a user to drive the drum roller 134 until a sheet 200 has advanced sufficiently.

With reference to FIG. 6, the push bar 152 is shown in isolation. As shown, the push bar 152 includes a main body 152*a* extending between a first end 152*b* and a second end 152*c*. The first and second ends 152*b*, 152*c* are received into apertures in the support walls 136, 138 and allow the push bar to rotate about an axis 152*x* within the dispensing mechanism 130. A paddle or handle 152*d* extends from the main body 152*a* and provides a user with a surface against which the user can push. The pushing motion of a user onto the paddle 152*d* causes the main body 152*a* to rotate about the axis 152*x* in a counterclockwise direction, from the views shown at FIGS. 7 and 7A. The push bar 152 additionally includes an extension member 152*e* extending from the main body 152*a*. The extension member 152*e* includes an aperture 152*f* that is offset from the axis 152*x* such that when the main body 152*a* rotates about the axis 152*x*, the aperture traces a path that circumscribes the axis 152*x* at a radial distance equal to the distance between the axis 152*x* and the aperture 152*f*. The aperture 152*f* is constructed to receive an end 154*a* of the torsion spring 154 while a coiled portion 154*b* of the torsion spring 154 is disposed about the main body first end 152*b*, as shown at FIG. 7A.

Figure 7A:
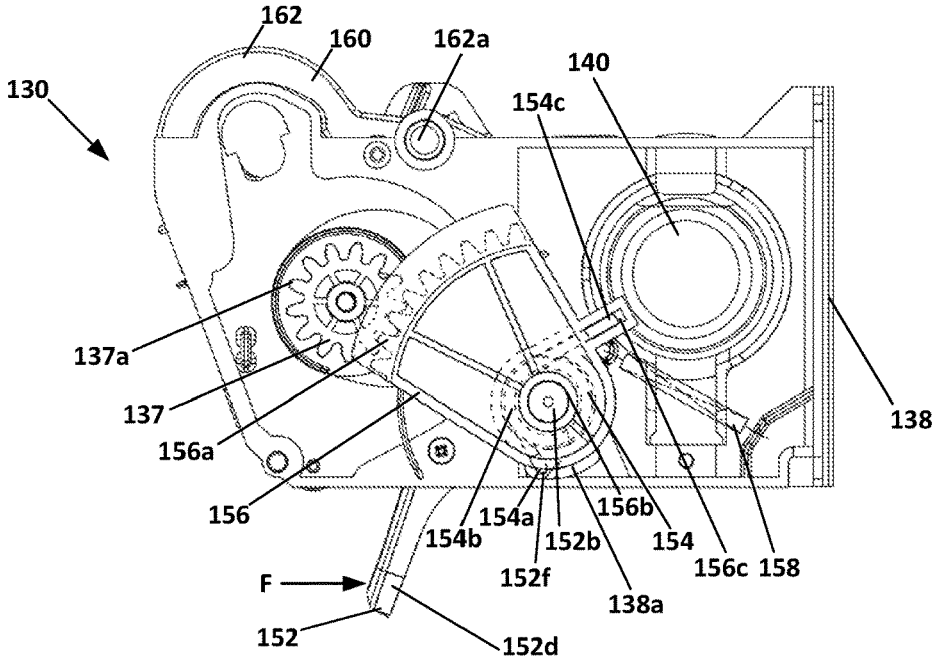
FIG. 7A is a side view of the dispensing assembly shown in FIG. 7, but with hidden lines of certain components shown.

With reference to FIGS. 7 and 7A, the segment gear body 156 is most easily viewed. As mentioned previously, the segment gear body 156 includes gear teeth 156*a*. The segment gear body 156 also includes an aperture 156*b* for mounting the segment gear body 156 about the push bar main body first end 152*a* and a torsion spring receiving area 156*c* which fixes a second end 154*c* of the torsion spring 154. It is noted that the aperture 156*b* is large enough to allow the segment gear body 156 to rotate with respect to the main body 152 and that the segment gear body 156 is rotatably mounted to the support wall 138.

Referring to FIG. 7A specifically, in operation, when a user exerts a pushing force F on the paddle 152*d* the push bar main body 152*a* will rotate about axis 152*x* in a counterclockwise direction. This rotation in turn causes the torsion spring 154 to be rotated at its first end 154*a*. As the second end 154*b* of the torsion spring 154 is fixed to the segment gear main body 156, the force of the torsion spring 154 causes the segment main gear body 156 to also rotate in the counterclockwise direction. When the segment gear main body 156 is rotated in this direction, the teeth 156*a* of the segment gear main body 156 interact with the teeth 137*a* of the drum roller drive gear 137 to cause the drum roller 134 to rotate in the clockwise direction to advance a sheet 200. After the user releases the push bar paddle 152*d*, a return spring 158, connected to the segment gear body 156 and the support wall 138, causes the segment gear main body 156 to rotate clockwise back to a starting position which in turn causes the push bar to rotate clockwise via the force of the torsion spring 152. The drum roller drive gear 137 is configured to only transmit torque to the drum roller 134 in the counterclockwise direction and thus spins freely when the segment gear body 156 is rotating back to the starting position. The starting position and the fully depressed position end points can be defined by a slot 138*a* in the support wall 138 through which the torsion spring 154 must pass in order to extend between the segment gear body 156 and the aperture 152*f* on the push bar 152.

As all force F exerted by a user on the push bar must be transmitted through the torsion spring 154 in order for the segment gear teeth 156*a* to drive the drum roll drive gear teeth 137*a*, the teeth 156*a*, 137*a* are protected from excessive forces that could cause them to be stripped. Additionally, the segment gear body 156, the push bar 152, and the drive gear 137 are also protected from torque forces that could cause mechanical failure of these components. With the limitations of the components understood, the torsion spring 154 is designed to only allow a maximum torque force to be transmitted through the spring 154 that is below a force that could damage any of the manual advance mechanism components 150, including teeth 156*a*, 137*a*. This configuration represents a significant advance over prior art dispensers in which the internal components related to a push bar are all in direct driving contact with each other without the use of a spring. In those types of systems, the presence of a paper jam may prevent the dispensation of paper 200 and a user may attempt to exert a force on the push bar that is sufficient to break the internal components or strip the teeth on interacting gears. Although the torsion spring 154 is shown as a helically wound spring with straight ends, other types of springs may be used without departing from the concepts presented herein.

Figure 11:
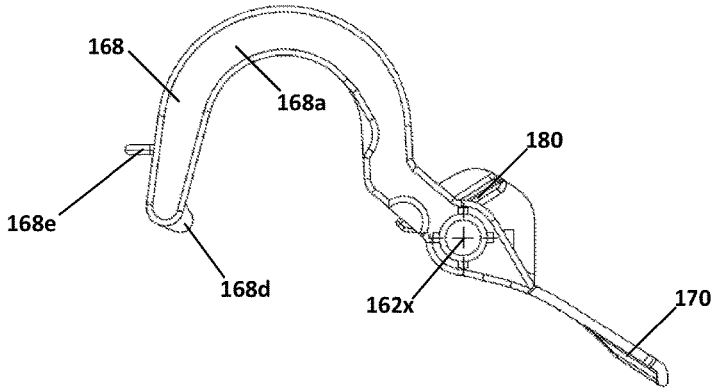
FIG. 11 is a side view of the transfer mechanism shown in FIG. 8.

With reference to FIGS. 3 and 7, 7A, the dispensing mechanism can also include a transfer bar 160. The transfer bar 160 is shown in isolation at FIGS. 8 to 11 and includes a main body 162 having a first pivot support 164 and a second pivot support 166. As can be seen at FIGS. 7 and 7A, the pivot supports 164, 166 rest in openings 141 of the support walls 136, 138 which enable the transfer bar 160 to be rotatably supported about an axis 162*x* by the walls 136, 138 with relatively little friction such that the transfer bar 160 can rotate generally freely. As most easily seen at FIG. 11, the transfer bar main body 162 further includes an arch-shaped pinch member 168 extending from the pivot axis 162*x* and a lift member 170 extending in an opposite direction from the pivot axis 162*x*. The pivot axis 162*x* is located such that the transfer bar 160, in the view at FIGS. 7, 7A, and 11, will rotate counterclockwise about the pivot axis 162*x* when supported by the first and second ends 164, 166. A lift member 168*e* may be provided on the transfer bar 160 so that an operator can lift the transfer bar 160 away from the pinch and drum rollers 132, 134.

The pinch member 168 is designed with a pair of arch-shaped members 168*a* that reach over the pinch roller 132 and contact the drum roller 134. Extending between the members 168*a* is a rail member 168*b* and a plate member 168*c*. A plurality of protrusions 168*d* extend from the rail member 168*b* in a direction towards axis 162*x*. When the pinch member 168 is at rest against the drum roller 134, the protrusions 168*d* extend into the grooves 134*b* of the drum roller 134 such that the protrusions extend beneath the surface defined by the friction surfaces 134*a*. When paper 200 is present between the pinch member 168 and the drum roller 134, the rail member 168*b* presses the paper 200 against the drum roller friction surfaces 134*a* while the protrusions 168*d* further urge the paper 200 into the grooves 134*b* for enhanced engagement between the drum roller 134 and the paper 200. As the drum roller rotates in the counterclockwise or feed direction, this action of the pinch member 168 ensures that the paper will be fed into the nip area defined by the pinch and drive rollers 132, 134 such that the paper will in turn be fed between the pinch and drive rollers 132, 134. The plate member 168*c* acts as a guide to ensure the paper 200 is fed towards the rail member 168*b* and protrusions 168*c*.

Figure 8A:
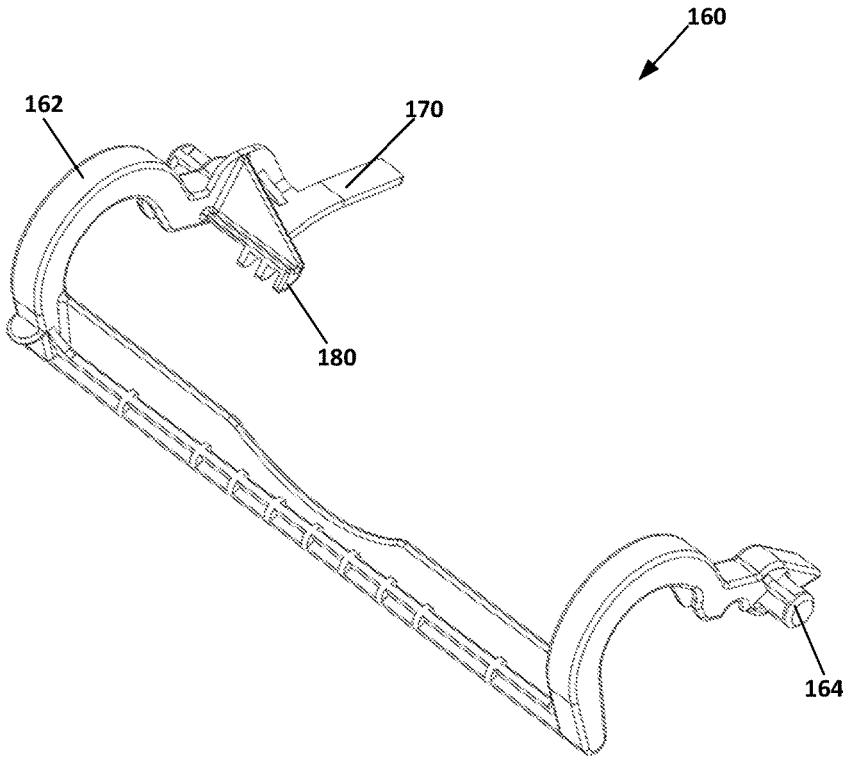
FIG. 8A is a perspective view of a modified version of the transfer mechanism shown in FIG. 8.
Figure 9:
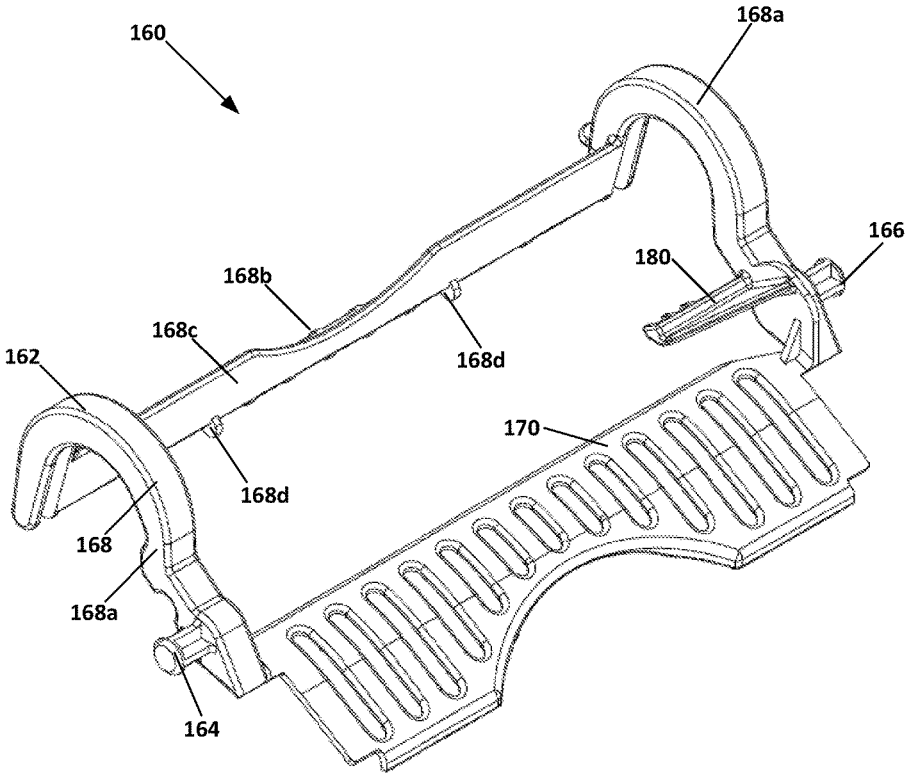
FIG. 9 is a perspective view of the transfer mechanism shown in FIG. 8.
Figure 10:
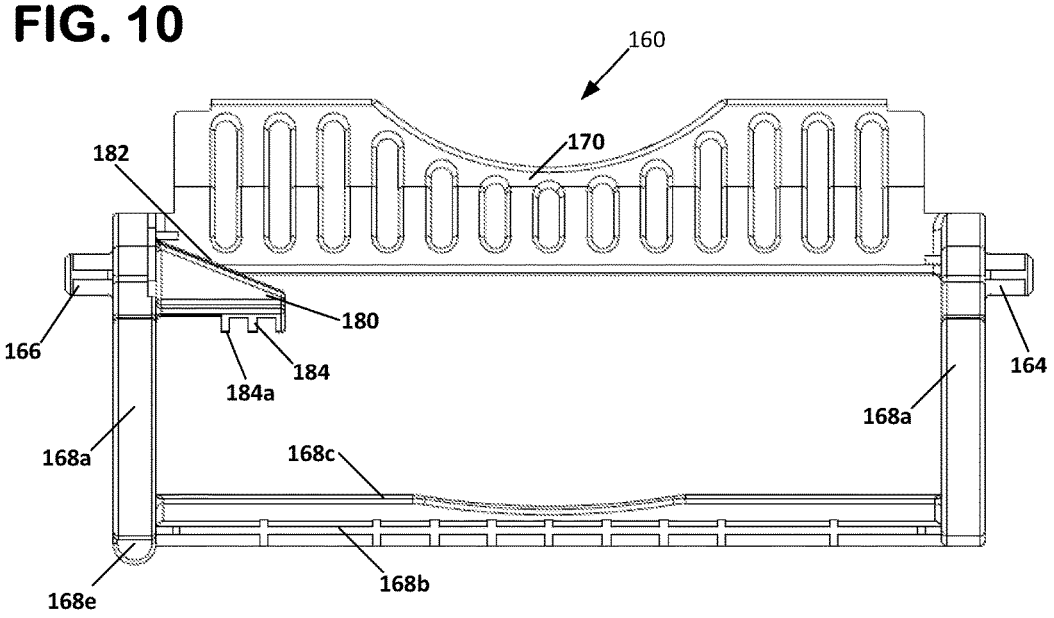
FIG. 10 is a top view of the transfer mechanism shown in FIG. 8.

In the example embodiment shown, the lift member 170 extends between the first and second pivot supports 164, 166 and extends in a direction away from the pivot axis 162*x*. In an alternative example shown at FIG. 8A, the lift member 170 is shown as only from the second pivot support. Other configurations are possible. As explained in further detail below, the length of the lift member 170 is such that the top surface of the lift member 170 will be depressed when the stub roll 204 is installed and supported by the stub roll supports 140. When this occurs, the entire transfer bar 160 is rotated about axis 162*x* such that the pinch member 168 is held away from the drum roller 134. Accordingly, the pinch member 168 is prevented from feeding a sheet 200 located below the pinch member 168 into the nip area such that it can be fed between the pinch and drive rollers 132, 134. Once the stub roll 204 is completely depleted, the lift member 170 will no longer be depressed by the stub roll 204, thereby allowing the pinch member 168 to rest against the drum roller 134. The lift member 170 can be designed with a length such that the lift member 170 only engages the stub roll 204 at a specified diameter of the stub roll 204. For example, the lift member 170 could have a length that only engages with the stub roll is about half-way depleted from the maximum stub roll diameter or fully depleted.

The transfer bar 160 also includes a cam lift 180 extending from the second pivot support 166. The cam lift 180 includes an upper ramped surface 182 that tapers in a direction away from the second pivot support 166 and includes a lower lift structure 184. When the primary roll 202 is initially moved into the stub roll location to become the stub roll 204, the stub roll 204 will depress the lift member 170, and the paper 200 from the stub roll 204 rests upon the cam lift ramped surface 182. As a user pulls sheets 200 from the dispenser, the side edge of the paper 200 will ride down and off the ramped surface 182 and will then relax back to its normal position, but underneath the lift structure 184. At this point, the presence of the paper 200 also ensures that the pinch member 168 is held away from the drum roller 134. Once paper 200 is depleted from the stub roll 204, the pinch member 168 will then be allowed to rotate against the drum roller 134. To reduce friction between the paper 200 and the lift structure 184, the lift structure 184 is provided with a plurality of tines 184*a* to give the lift structure 184 a comb arrangement.

With the disclosed configuration, the transfer bar 160 is doubly prevented from prematurely rotating such to a position where the pinch member 168 is against the drum roller 134, when paper in the stub roll 204 exists, by the combined features of the lift member 170 and by the cam lift 180. As the exact diameter of the stub roll 204 when completely depleted can be difficult to ascertain, providing only the lift member 170 could result in premature transfer over to the primary roll 202 or could result in the dispenser feeding paper from both the primary and stub rolls 202, 204. Although the cam lift 180 could ensure that premature transfer does not occur, the presence of the lift member 170 significantly reduces friction between the cam lift 180 and the paper 200 since a significant portion of the weight of the transfer bar 160 is supported by the interaction between the lift member 170 and the stub roll 204. Without the presence of the lift member 170, the entire weight of the transfer bar 160 would be supported solely by the paper 200 below the lift structure 184 which even may cause ripping of the paper 200. The presence of the lift member 170 also allows for the transfer bar 160 to be supported during the initial transfer of the paper 200 from the ramped surface 182 to beneath the lift structure 184*a*. Because of this, the transfer of paper to the stub roll location is greatly simplified for maintenance personnel in that all that is required is to simply move the primary roll 202 to be supported by the stub roll supports 140. The movement of the paper 200 from the ramped structure to below the lift structure 184 is completed entirely automatically by the simple process of a user pulling a sheet 200 from the dispenser. In contrast, many prior art configurations where lift members are utilized require that a person carefully manipulate the paper to below the lift members. This procedure can be cumbersome and time intensive. As typical prior art transfer bars require lift structures at each end of the transfer bar (because the transfer bar is not independently supported by a lift member 170, as disclosed herein), these types of transfer bars generally have relatively long lift members at each end, thereby making the procedure even more difficult.

Figure 12A:
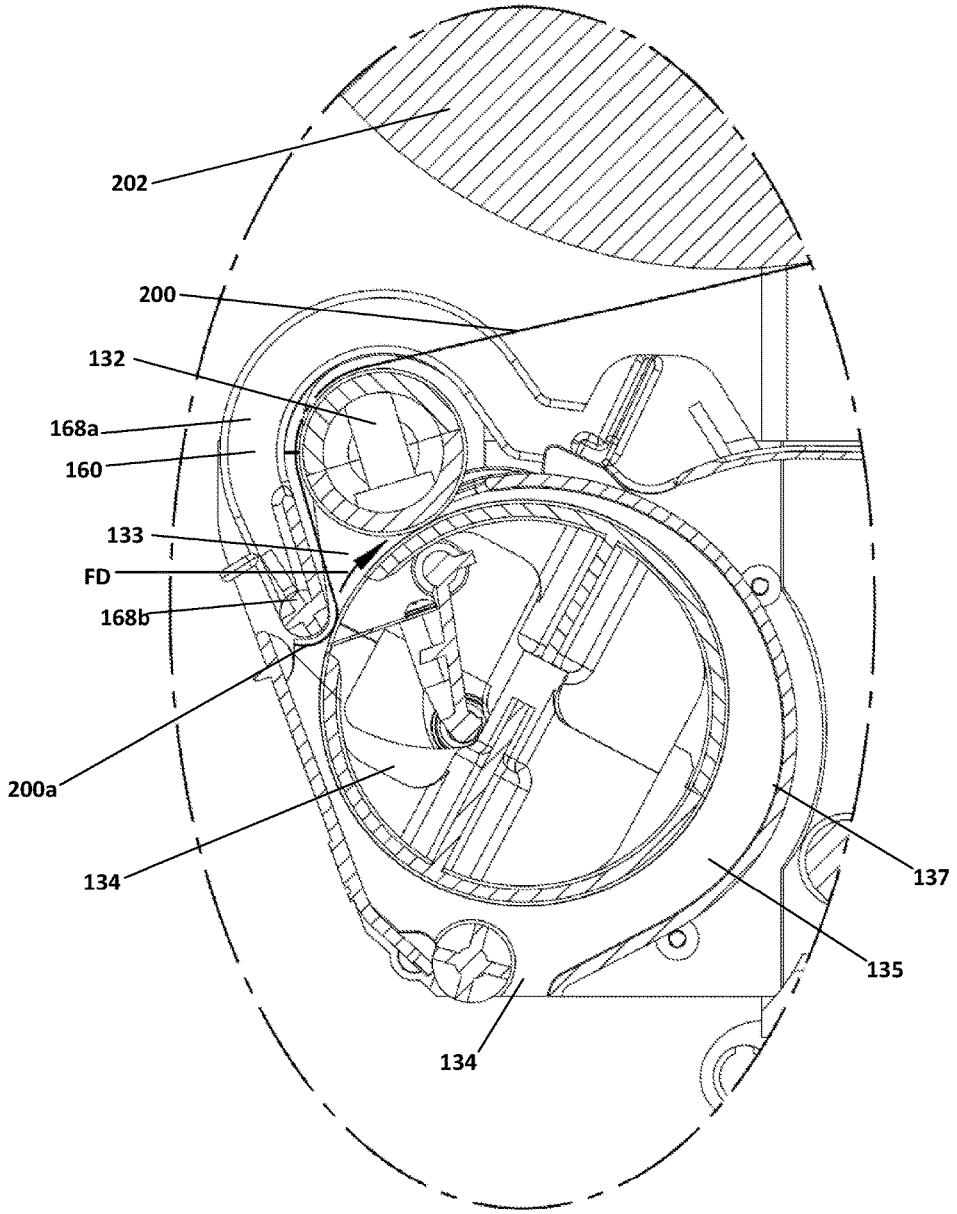
FIG. 12A is an enlarged portion of the dispenser view shown in FIG. 12.
Figure 13:
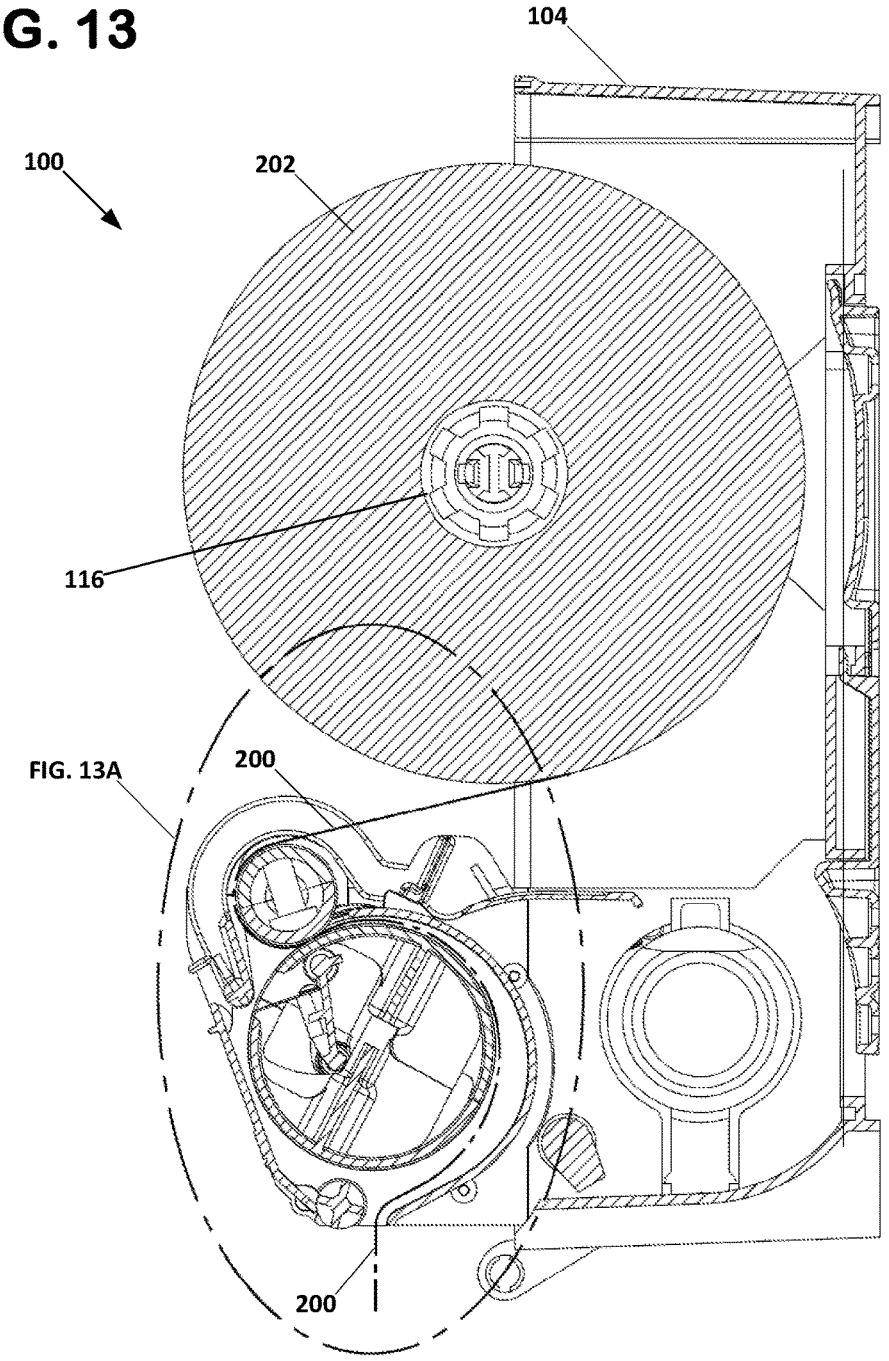
FIG. 13 is a side cross-sectional view of the dispenser shown in FIG. 1 after the primary roll paper has been fed from the position shown in FIG. 12 to a point where the end of the paper has been discharged through the outlet opening of the dispenser.
Figure 13A:
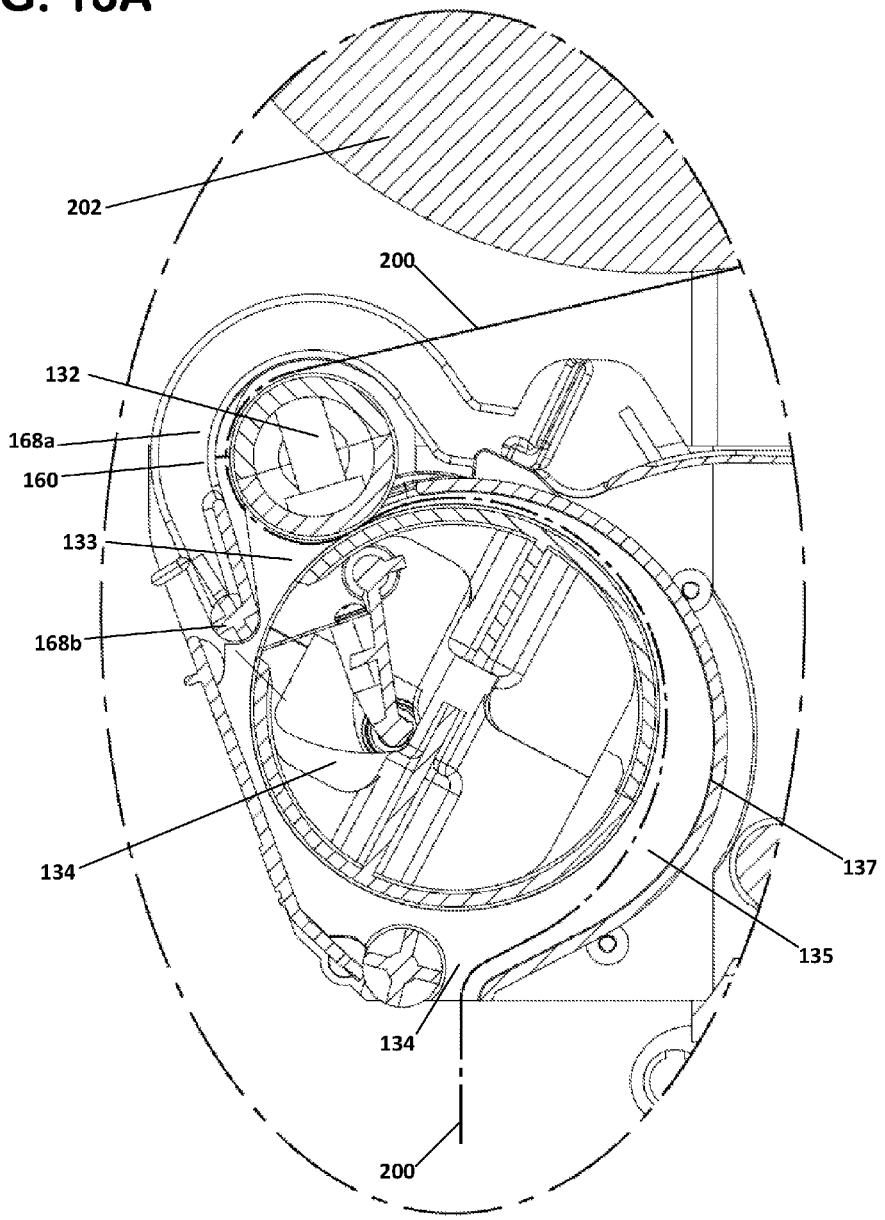
FIG. 13A is an enlarged portion of the dispenser view shown in FIG. 13.

Referring to FIGS. 12-16A, the above described operation is illustrated in further detail. As can be seen at FIG. 12, a primary roll 202 has been installed into the dispenser 100. FIG. 12A shows an enlarged portion of the dispenser shown in FIG. 12. In this view, an operator has lifted and released the transfer bar 160, after a front end 202*a* of paper 200 from a newly installed primary roll 202 has been placed over the pinch roller 132. Accordingly, the rail member 168*b* and protrusions 168*d* are holding the paper 200 against the drum roller 134. Once the operator pushes on the push bar 152*d*, the drum roller 134 and pinch roller 132 will be driven in the feed direction FD, thereby causing the paper 200 to be pulled into the nip area 133 and ultimately between the pinch and drive rollers 132, 134. After passing between the rollers 132, 134, the paper 200 passes into a chute area 135 defined by the drum roller 134 and a chute wall 137 extending between the support walls 136, 138. The paper 200 then discharges through opening 134 in the dispensing mechanism 130 and opening 106*a* in the dispenser housing 102, where a user can pull the sheet 200. FIGS. 13 and 13A show this advancement of the paper 200 up to this point.

Figure 14:
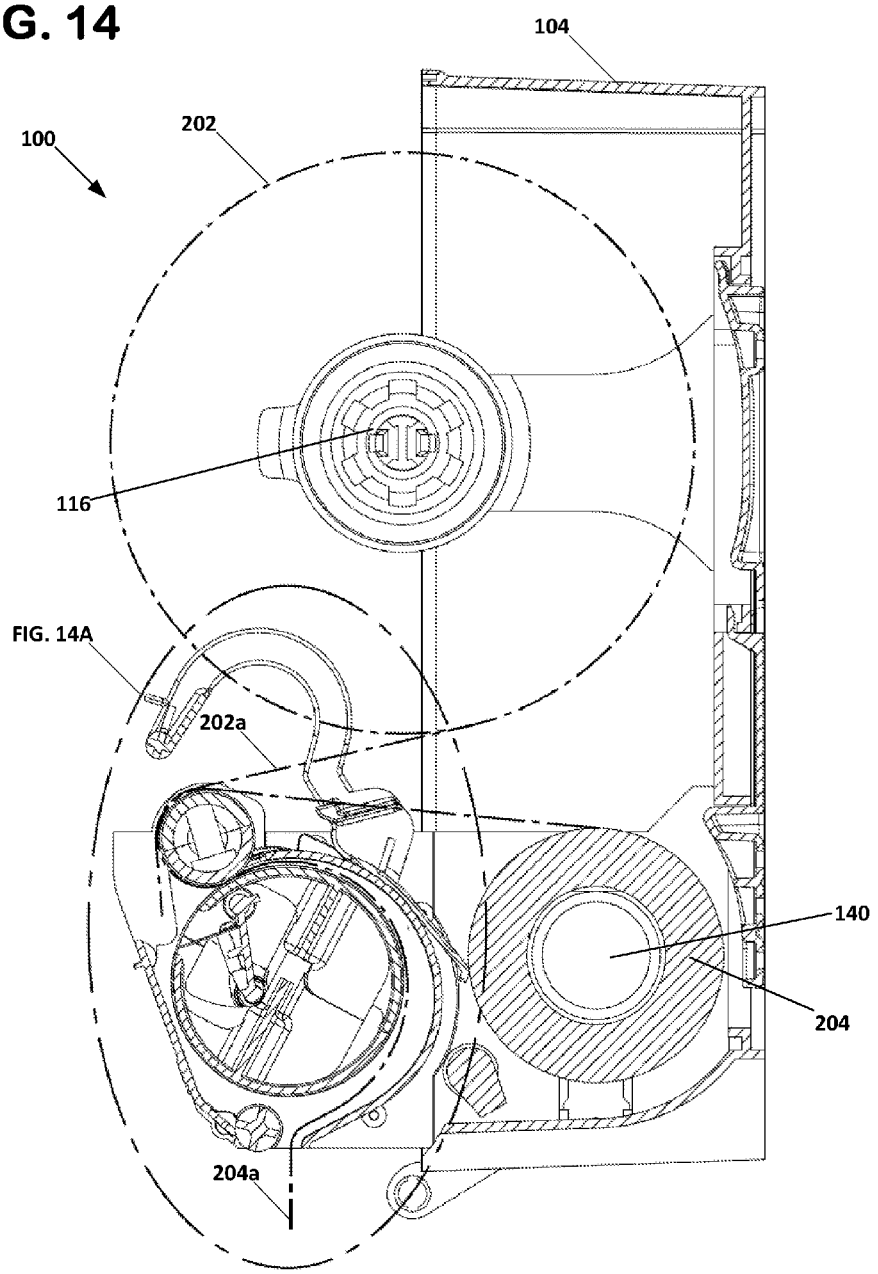
FIG. 14 is a side cross-sectional view of the dispenser shown in FIG. 1 after the primary roll paper has been partially depleted and moved to the stub roll location and after a new primary roll has been installed, and wherein the paper from the stub roll is above a cam lift member of the transfer mechanism.
Figure 14A:
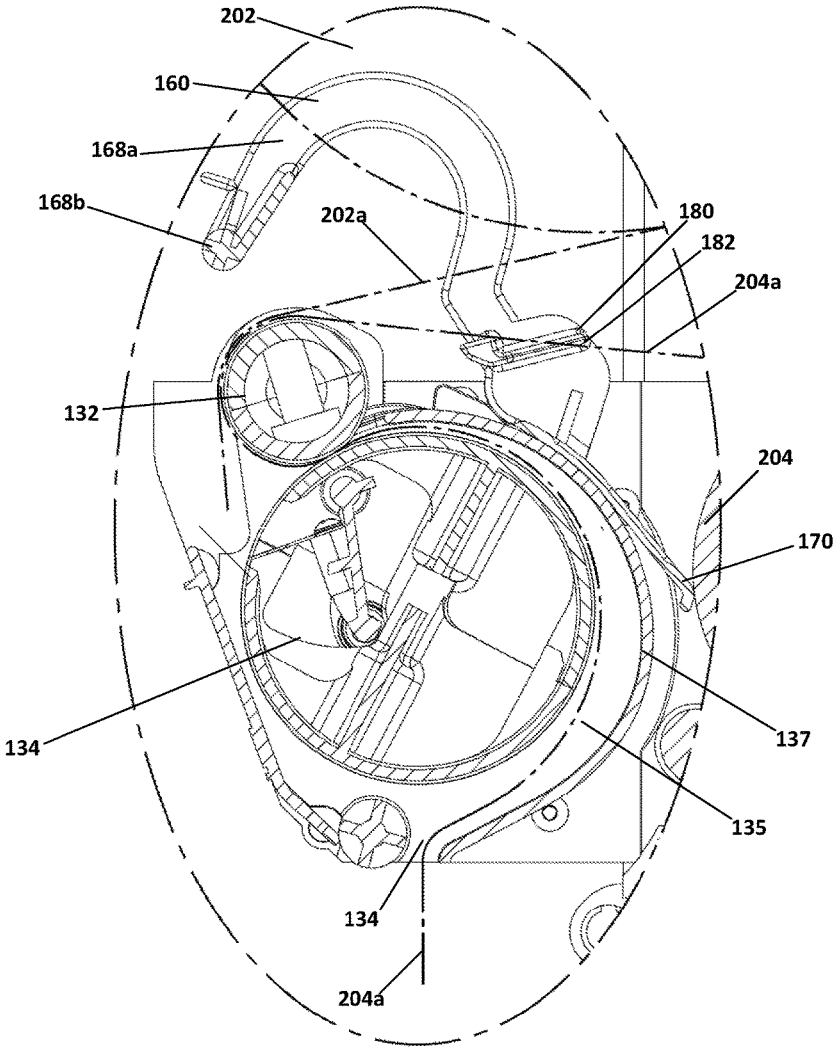
FIG. 14A is an enlarged portion of the dispenser view shown in FIG. 14.

Referring to FIGS. 14 and 14A, it can be seen that the dispensing operation has continued until the point that the primary roll 202 has been sufficiently depleted and placed in the stub roll location to become the stub roll 204. A new primary roll 202 has also been installed. For ease of reference, paper fed from the primary roll location will be referred to as paper 202*a* while paper fed from the stub roll location will be referred to as paper 204*a* in FIGS. 14-16A. Still referring to FIGS. 14 and 14A, it can be seen that the paper 204*a* from the stub roll 204 is held above the cam lift 180 by the ramped surface 182 and that the stub roll 204 has pushed against the lift member 170 to cause the transfer bar 160 to disengage away from the drum roller 134. Also, the paper 202*a* from the primary roll 202 has been routed to hang over the paper 204*a* from the stub roll 204 that is wrapped about the pinch roller 132. Without the presence of the transfer bar 160, the paper 202*a* from the primary roll 202 will simply ride atop the paper 204*a* as paper 204*a* advances around the pinch roller 132 as insufficient friction exists between the papers 202*a*, 204*a* to cause the paper 202*a* to also advance into the nip area 133.

Figure 15:
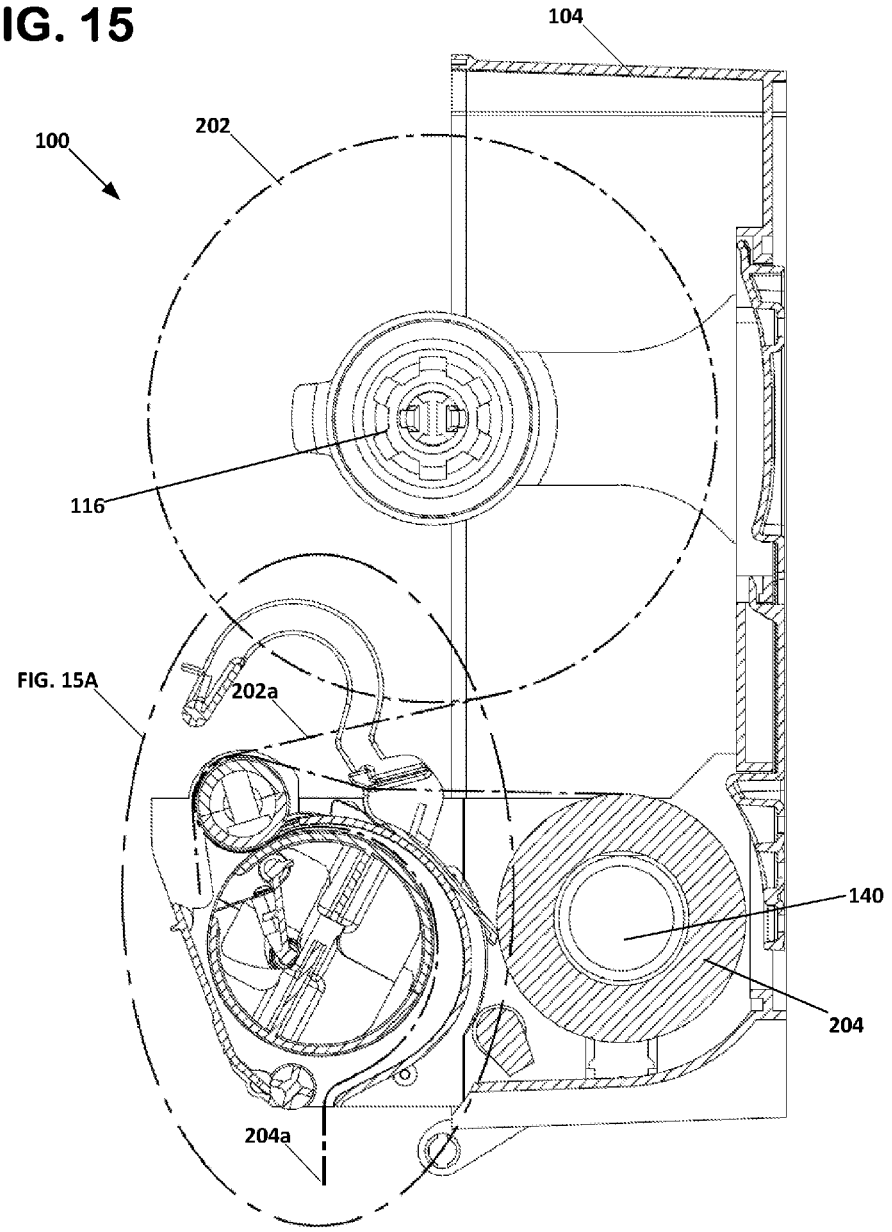
FIG. 15 is a side cross-sectional view of the dispenser shown in FIG. 1 after the paper from the stub roll has advanced from the position shown in FIG. 14 to a position in which the paper from the stub roll is beneath the cam lift member of the transfer mechanism.
Figure 15A:
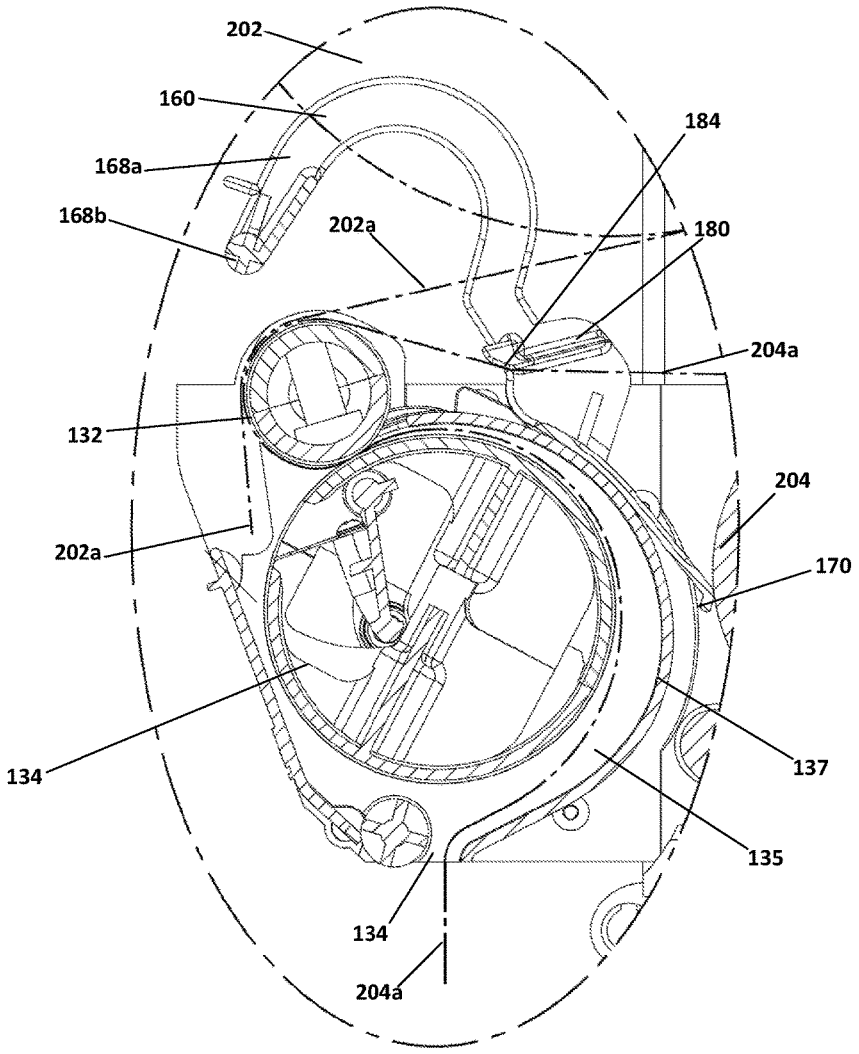
FIG. 15A is an enlarged portion of the dispenser view shown in FIG. 15.

Referring to FIGS. 15 and 15A, it can be seen that paper 204*a* from the stub roll 204 has advanced and that the paper 204*a* has automatically transferred from the ramp surface 182*a* to below the lift structure 184 while the transfer bar 160 has been held away from the pinch roller by the interaction between the stub roll 204 and the lift member 170. From this position, the paper 204*a* will continue to feed out from the stub roll 204 until completely depleted such that paper 204*a* no longer exists to hold the pinch member 168 away from the drum roller 134 via depressing the lift member 170 and upholding the lift structure 184. During this process, the transfer bar 160 gradually lowers towards the drum roller 134 as the paper 204*a* is depleted. Once full depletion of the stub roll 204 occurs, the pinch member drops 168 to engage the paper 202*a* against the drum roller 134 such that paper 202*a* from the primary roll 202 can be dispensed, in the same manner as previously described and illustrated at FIGS. 12 to 13A.

Figure 16:
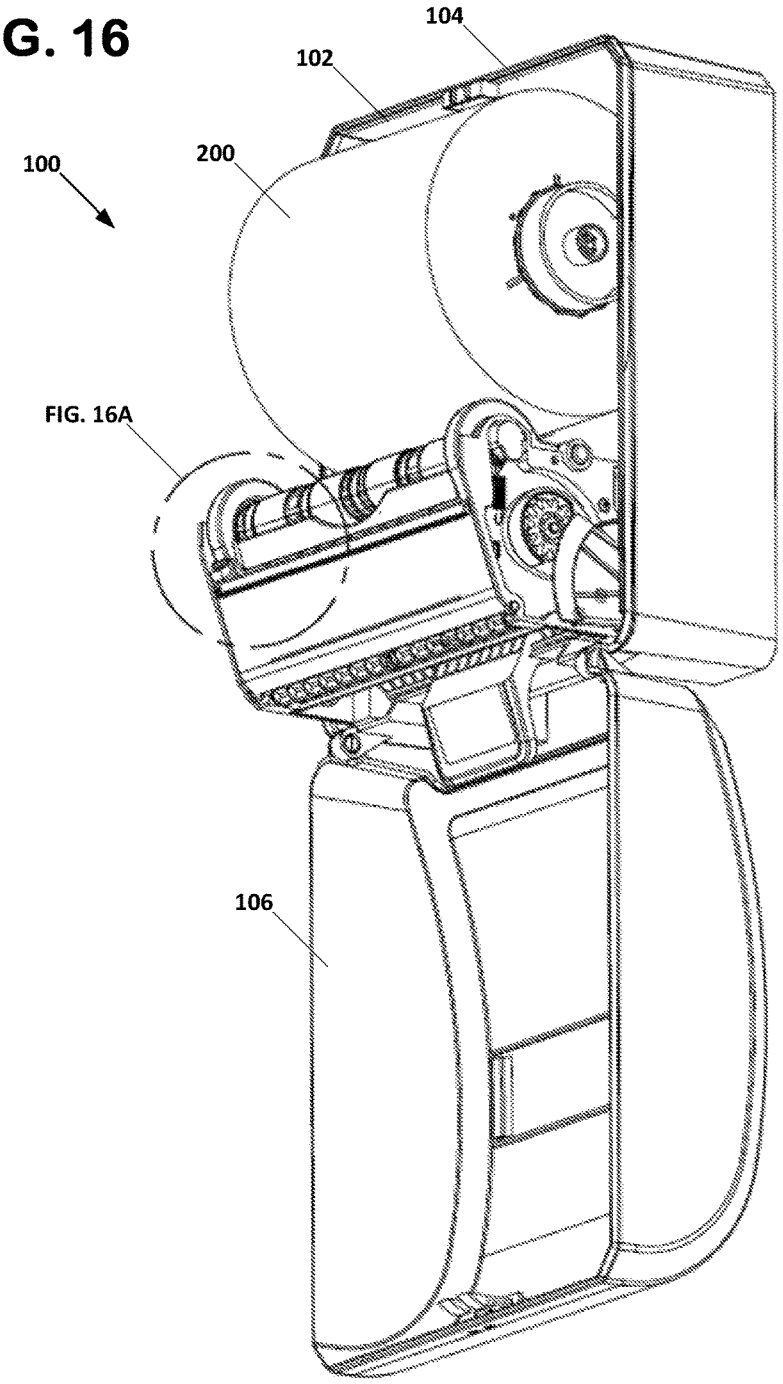
FIG. 16 is a modified version of the dispenser shown in FIGS. 1-15A, with the addition of a position switch for the transfer mechanism.
Figure 16A:
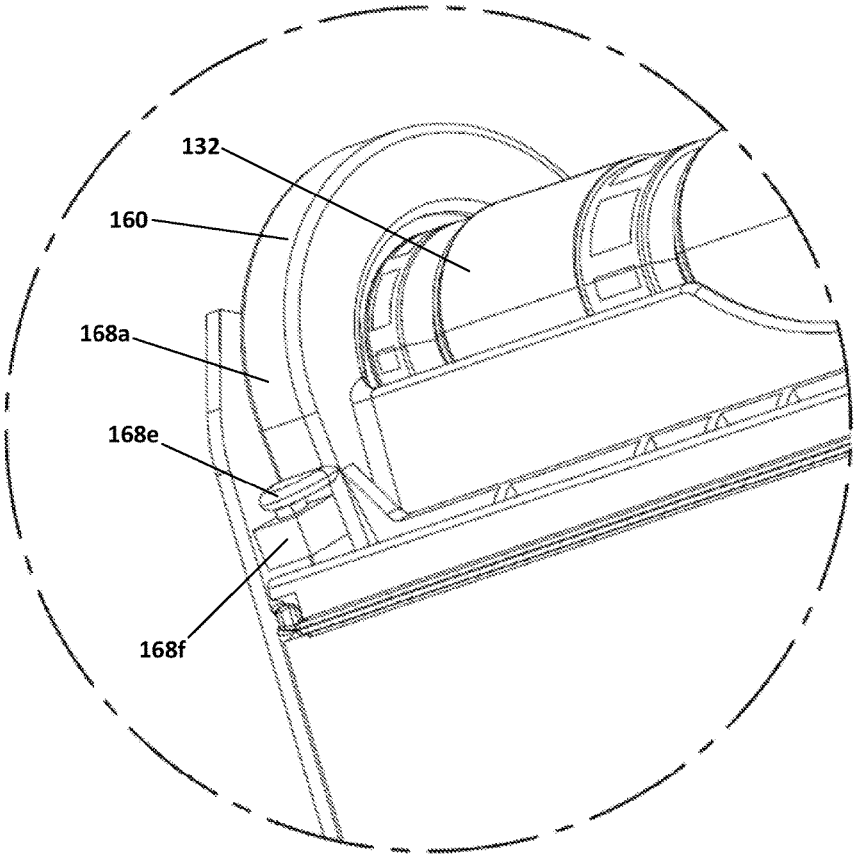
FIG. 16A is an enlarged portion of the dispenser view shown in FIG. 16.

Referring to FIGS. 16 and 16A, it can be seen that the dispenser can be provided with a sensor or switch 168*f* for positively verifying that the transfer bar 160 has fully dropped into the transfer position after the stub roll 204 has been depleted. The output from the sensor or switch 168*f* can be used in a variety of ways. For example, where an automatic advance motor is provided (instead of a manual advance mechanism), a signal can be sent to cycle the motor such that the drum roller 134 is caused to rotate through a predefined number of revolutions to ensure that paper 202*a* from the primary roll 202 is sufficiently advanced through the discharge opening 106*a* after transfer from the stub roll 204 to the primary roll 202 has occurred.

From the forgoing detailed description, it will be evident that modifications and variations can be made without departing from the spirit and scope of the disclosure. In the following section, text is provided in the form of claims. The claims comprise characterizations indicating a variety of options, features, and feature combinations that can be used in accord with the teachings of the present disclosure. Alternate characterizations of the ones given, but consistent with the descriptions herein above, are possible.

We claim:

1. A rolled media dispenser comprising:
(a) a housing defining an interior cavity;
(b) a primary roll support arrangement;
(c) a stub roll support arrangement;
(d) a pinch roller;
(e) a drum roller;
(f) an outlet opening; and
(g) a transfer mechanism pivotally mounted within the housing interior cavity, the transfer mechanism having:
(i) a pivot axis;
(ii) a pinch member extending in a first direction from the pivot axis;
(iii) a lift member extending in a second direction from the pivot axis, the lift member holding the pinch member away from the drum roller when a roll of media is held within the stub roll support arrangement;
(iv) a cam lift member located between the lift member and the pinch member, the cam lift being for preventing rotation of the transfer mechanism such that the pinch member is held away from the drum roller when media from the stub roll exists; wherein the pinch member includes a pair of arch-shaped members that reach over the pinch roller and contact the drum roller; wherein the pinch member includes a rail member and a plate member extending between the arch-shaped members.

2. The rolled media dispenser of claim 1 further including a manual advance mechanism to manually drive the drum roller.

3. The rolled media dispenser of claim 2 wherein the manual advance mechanism includes a drive gear on the drum roller; a segment gear engaged with the drive gear; and a push bar connected to the segment gear.

4. The rolled media dispenser of claim 3 wherein the manual advance mechanism includes a torsion spring, and the push bar is connected to the segment gear by the torsion spring.

5. The rolled media dispenser of claim 1 wherein the transfer mechanism includes a first pivot support and a second pivot support, the lift member extending between the first and second pivot supports.

6. The rolled media dispenser of claim 5 wherein the cam lift member extends from one of the first and second pivot supports.

7. The rolled media dispenser of claim 6 wherein the cam lift member extends from the second pivot support and includes a ramped surface that tapers in a direction away from the second pivot support.

8. The rolled media dispenser of claim 7 wherein the cam lift member includes a lower lift structure including a plurality of tines.

9. The rolled media dispenser of claim 1 wherein:
(a) the drum roller includes a plurality of grooves; and
(b) the rail member includes a plurality of protrusions extending therefrom, so that when the pinch member is at rest against the drum roller, the protrusions extend into the grooves of the drum roller.

10. The rolled media dispenser of claim 1 wherein the housing includes a housing body and a cover removably mountable to the housing body.

11. The rolled media dispenser of claim 1 further comprising an indicator arrangement to indicate when a primary roll that is held by the primary roll support arrangement has been at least partially depleted.

12. The rolled media dispenser claim 1 wherein the transfer mechanism is part of a dispensing mechanism, the dispensing mechanism being selectively removable from the housing.

13. The rolled media dispenser of claim 1 wherein the drum roller includes an internal cutting blade.

14. The rolled media dispenser of claim 1 further including a sensor to verify that the pinch member has dropped into a transfer position and in a direction toward the drum roller after media from the stub roll is depleted.

15. A rolled media dispenser comprising:
(a) a housing defining an interior cavity;
(b) a primary roll support arrangement;
(c) a pinch roller;
(d) a drum roller having a drive gear;
(e) an outlet opening; and
(f) a manual advance mechanism including a push bar, a torsion spring, and a segment gear engaged with the drive gear, wherein the push bar is torsionally connected to the segment gear by the torsion spring; a transfer mechanism pivotally mounted within the housing interior cavity, the transfer mechanism having: (a) a pivot axis; (b) a pinch member extending in a first direction from the pivot axis; (c) a lift member extending in a second direction from the pivot axis, the lift member holding the pinch member away from the drum roller when a roll of media is held within the stub roll support arrangement; and (d) a cam lift member located between the lift member and the pinch member, the cam lift being for preventing rotation of the transfer mechanism such that the pinch member is held away from the drum roller when media from the stub roll exists; wherein the pinch member includes a pair of arch-shaped members that reach over the pinch roller and contact the drum roller; wherein the pinch member includes a rail member and a plate member extending between the arch-shaped members.

16. The rolled media dispenser of claim 15 wherein the transfer mechanism includes a first pivot support and a second pivot support, the lift member extending between the first and second pivot supports.

17. The rolled media dispenser of claim 16 wherein the cam lift member extends from one of the first and second pivot supports.

* * * * *